US009993860B2

(12) United States Patent
Flehmig

(10) Patent No.: US 9,993,860 B2
(45) Date of Patent: Jun. 12, 2018

(54) DEVICE AND METHOD FOR PRODUCING AT LEAST PARTIALLY CLOSED HOLLOW PROFILES WITH ROTATABLE DIE HALVES AND LOW CYCLE TIME

(71) Applicant: Thomas Flehmig, Ratingen (DE)

(72) Inventor: Thomas Flehmig, Ratingen (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 1325 days.

(21) Appl. No.: 13/794,041

(22) Filed: Mar. 11, 2013

(65) Prior Publication Data

US 2013/0186165 A1 Jul. 25, 2013

Related U.S. Application Data

(63) Continuation of application No. PCT/EP2011/065726, filed on Sep. 12, 2011.

(30) Foreign Application Priority Data

Sep. 14, 2010 (DE) ..... 10 2010 037 534

(51) Int. Cl.
*B21D 22/00* (2006.01)
*B21D 5/01* (2006.01)

(52) U.S. Cl.
CPC ..... *B21D 22/00* (2013.01); *B21D 5/015* (2013.01)

(58) Field of Classification Search
CPC .. B30B 7/00; B30B 7/04; B21D 5/015; B21D 5/00; B21D 5/02; B21D 22/00; B21D 22/02
See application file for complete search history.

(56) References Cited

U.S. PATENT DOCUMENTS 136,654 A * 3/1873 Kintz ..... B21D 5/015 72/471
137,475 A * 4/1873 Parmelee ..... B21D 5/015 72/398
1,330,782 A * 2/1920 Brown ..... B21D 5/015 59/27

(Continued)

FOREIGN PATENT DOCUMENTS

DE 8536655.2 2/1986
DE 102007021798 A1 11/2008

(Continued)

*Primary Examiner* — R. K. Arundale
*Assistant Examiner* — Pradeep C Battula
(74) *Attorney, Agent, or Firm* — Reinhart Boerner Van Deuren P.C.

(57) ABSTRACT

The invention relates to a device for forming an at least in part closed hollow profile from a board a with a tool comprising a first half having an at least a U-stamp and at least an upper cavity and a second half having two identical at least in part U-shaped die cavities. The U-stamp and the upper cavity of the first tool half are each meshed with an at least in part U-shaped cavity when the tool is shut. The at least one U-stamp and the at least one upper cavity of the first tool half and the at least two at least in part U-shaped die cavities of the second tool half are arranged in a rotationally symmetrical manner to the rotational axis running in the closing direction of the tool.

12 Claims, 4 Drawing Sheets

(56) References Cited

U.S. PATENT DOCUMENTS

| | | | | | |
|---|---|---|---|---|---|
| 1,387,199 | A * | 8/1921 | Small | B21C 37/0815 | 138/171 |
| 1,978,685 | A * | 10/1934 | Mogford | B21D 53/90 | 228/144 |
| 2,077,336 | A | 4/1937 | Lemming | | |
| 2,532,302 | A * | 12/1950 | Hayward | B21D 53/085 | 165/150 |
| 3,719,985 | A * | 3/1973 | Federspill | B21D 51/10 | 29/414 |
| 4,286,454 | A * | 9/1981 | Bachmann | B21J 9/02 | 470/140 |
| 4,466,267 | A | 8/1984 | Casler et al. | | |
| 5,510,153 | A * | 4/1996 | Lilienthal, II | H01R 13/5216 | 174/110 S |
| 5,581,860 | A * | 12/1996 | Sawdon | B21D 39/031 | 29/243.5 |
| 7,350,386 | B2 * | 4/2008 | Streubel | B21C 37/0815 | 219/61 |
| 7,658,089 | B2 * | 2/2010 | Zdravkovic | B21D 39/031 | 72/21.4 |
| 8,276,428 | B2 | 10/2012 | Brüggenbrock et al. | | |
| 8,459,076 | B2 * | 6/2013 | Flehmig | B21C 37/08 | 72/380 |

FOREIGN PATENT DOCUMENTS

| | | | |
|---|---|---|---|
| EP | 1690607 | A1 | 8/2006 |
| GB | 327010 | | 3/1930 |
| JP | 48-34061 | | 5/1973 |
| JP | S6084829 | A | 5/1985 |
| JP | 61-200612 | U | 12/1986 |
| JP | 07-299520 | | 11/1995 |

* cited by examiner

DEVICE AND METHOD FOR PRODUCING AT LEAST PARTIALLY CLOSED HOLLOW PROFILES WITH ROTATABLE DIE HALVES AND LOW CYCLE TIME

CROSS-REFERENCE TO RELATED PATENT APPLICATIONS

This patent application is a continuation of PCT/EP2011/065726, filed Sep. 12, 2011, which claims priority to German Application No. 102010037534.9, filed Sep. 14, 2010, the entire teachings and disclosure of which are incorporated herein by reference thereto.

FIELD OF THE INVENTION

The invention relates to a device to produce an at least in part closed hollow profile from a board by means of a U-O-forming with a tool comprising at least a U-stamp and at least an upper cavity in a first tool half. The invention also relates to a method to produce an at least in part closed hollow profile from a board.

BACKGROUND OF THE INVENTION

At least in part closed hollow profiles are often used in the construction of motor vehicles to replace profiles which are open and welded together. The number of forming steps resulting from the complex shaping is a barrier to an economically viable method of manufacture. The standard U-O-forming used requires at least two forming steps, whereby each forming step is carried out separately in at least one press and the component is passed on between the work stations. In a favourable embodiment, one complete part can be manufactured per press hub, but this device requires extensive tool sets and a plurality of robots or feeders to transport the boards or semi-completed boards between the individual presses. In particular, there is the problem that with the U-O-forming the initially at least in part U-shaped board is removed from the cavity and places in the cavity for O-forming. This results in technical processing problems, in particular related to an imbalance during insertion into the O-cavity. Problems with particularly resilient materials may arise in that they cannot readily be inserted into the cavity for O-forming. From the patent application DE 10 2007 021 798 A1 made by the applicant, a device for producing at least in part closed profiles is known, which comprises a displaceable base plate and a displaceable stamp, such that the initially U-shaped formed board can remain in the relevant matrix before the O-forming. The cycle time which can be achieved by this device could be improved, as a complete part is only achieved with every second press stroke. The apparatus costs for this device are also relatively high.

BRIEF SUMMARY OF THE INVENTION

On this basis, the object of the present invention is to suggest a device and a method to produce at least in part closed hollow profiles from a board which enables the production of corresponding profiles with a short cycle time and high process stability.

Embodiments of the invention relate to a device to produce an at least in part closed hollow profile from a board by means of a U-O-forming with a tool comprising at least a U-stamp and at least an upper cavity in a first tool half. The object of suggesting a device and a method for the production of at least in part closed hollow profiles from a board which would enable the production of corresponding profiles with a short cycle time and high process reliability, is achieved by a device in which at least two identical at least in part U-shaped die cavities are provided in a second tool half, the U-stamp and the upper cavity of the first tool half are each meshed with an at least in part U-shaped cavity when the tool is shut, the at least one U-stamp and the at least one upper cavity of the first tool half and the at least two at least in part U-shaped die cavities of the second tool half are arranged in a rotationally symmetrical manner to the rotational axis running in the closing direction of the tool and the first and the second tool halves are rotatable relative to one another about this rotational axis such that when it is rotated the first and/or the second tool half of the U-stamp and the upper cavity can each mesh with the first or the second at least in part U-shaped cavity.

In accordance with a first teaching of this invention, the object is achieved by a device in which at least two identical at least in part U-shaped die cavities are provided in a second tool half, the U-stamp and the upper cavity are each meshed with an at least in part U-shaped matrix when the tool is shut, the at least one U-stamp and the at least one upper cavity of the first tool half and the at least two at least in part U-shaped die cavities of the second tool half are arranged in rotational symmetry to a rotational axis running in the closing direction of the tool and the first and second tool halves are rotatable relative to one another about this rotational axis, such that when it is rotated the first and/or the second tool half of the U-stamp and the upper cavity can each mesh with the first or the second at least in part U-shaped cavity.

The device according to the invention has in a tool shaping elements arranged in rotational symmetry for carrying out a U-forming of a level board and an O-forming of an at least in part U-shaped board to create a complete at least in part closed hollow profile in the two tool halves. This enables it, for example by a simple rotation of the first tool half towards the second tool half, that the board formed at least in part into a U-shaped board together with the upper cavity can be formed into an at least in part closed profile without the board having to be removed from the U-shaped cavity. If a level board is inserted into the other U-shaped board at the same time, the next time the tool is closed a component can be completed if the tool halves are rotated towards once another beforehand. As a result, the cycle times for the production of at least in part closed hollow profiles are very low. Furthermore, the danger of damaging the board by changing the die cavities before completing the in part closed hollow profiles is avoided.

The device according to the invention can in this way further be designed such that the first or the second tool half can be formed in a fixed manner, the first or the second tool half being arranged on a mounting plate which is rotatable about the rotational axis. Normally, only one of the tool halves, the first or the second tool half, is arranged on a mounting plate, which is housed in a rotatable manner about the rotational axis. This has the advantage that the costs for the production of the device are kept lower and, furthermore, parts of the device which are prone to wear and moving parts are avoided. However, it is also conceivable for the two tool halves each to be arranged in a rotatable manner on a mounting plate in order, for example, to minimise the cycle times by halving the rotation angle of the tool halves.

In order to produce complex shapes but also to improve the moulding of the at least in part closed hollow profiles, preferably, a core pulling device can be provided for each matrix of the second tool half. The core pulling device enables the simple insertion of a support core in the at least in part U-shaped formed board in front of the O-forming into an at least in part closed hollow profile.

The device according to the invention can further be additionally improved by guides being assigned to the U-stamp in the first tool half. Guides are required, in particular, to control the insertion of materials in the production of an at least in part U-shaped board.

Preferably, the at least in part U-shaped cavity of the second tool half has side walls, the height of which is at least half of the maximum, rolled out side wall length of the hollow profile to be produced. The maximum rolled out side wall length of the hollow profile to be produced corresponds to the maximum length of a U-arm of the at least in part U-shaped transformed board before its O-forming. The side walls of the at least in part U-shaped die cavities enable a forming of the at least in part U-shaped boards with high process reliability in the following O-forming, since with this the threading process of the arm of the at least in part U-shaped board into the upper cavity is improved.

The capacity of the device can be increased by the first tool half having a plurality of U-stamps and upper die cavities arranged in pairs and in a rotationally symmetrical manner and the second tool half having an identical number of at least in part U-shaped die cavities which are arranged in a rotationally symmetrical manner to the respective rotation axis. In other words, for example two rotatable partial tools each with a U-stamp and each with an upper cavity may be present in a tool half of the device. In connection with the identical die cavities arranged opposite, each work stroke can produce two completely formed at least in part closed hollow profiles. Thus, the capacity of the device can for example be doubled. Increasing the number of forming elements can both decrease cycle times and integrate further processing steps into the same device.

According to a second teaching of the present invention, the above object is achieved by a method which uses the device according to the invention and comprises the following steps:

- Insertion of a first level board into a first at least in part U-shaped cavity of the second tool half,
- Forming of the first board into an at least in part U-shaped board by closing the tool halves using the U-stamp of the first tool half,
- Opening of the tool and rotation of the first and second tool halves against one another along a rotational axis in the closing direction of the tool such that the U-stamp of the first tool half is positioned above the second at least in part U-shaped cavity of the second tool half and the upper cavity of the first tool half is positioned above the first at least in part U-shaped cavity of the second tool half,
- Insertion of a second level board into a second at least in part U-shaped cavity of the second tool half,
- Closing of the tool halves and simultaneous forming of the in part U-shaped first board into an at least in part closed hollow profile using the upper cavity of the first tool half and simultaneously forming the second board into an at least in part U-shaped board using the U-stamp of the first tool half.

Using the method according to the invention, it is possible to produce an in part closed hollow profile with particularly short cycle times with each closing stroke of the tool if both U-shaped die cavities are assembled before the next closing stroke with the parts to be formed. The simple construction of the device according to the invention means that the costs of the method are correspondingly low.

Preferably, the first and/or the second tool half is rotated about the rotational axis following the opening of the tool. It is particularly advantageous if one of the tool halves is formed in a fixed manner so that a drive is not necessary to carry out the rotation. In this case, the additional drives are not needed and the apparatus costs are lower. However, it is also conceivable, as already mentioned, for the two tool halves to be rotated in opposite directions about the rotational axis in order to mesh with one another again, in order to halve the rotation angle of both tool halves and to this extent also reduce the cycle times.

The O-forming can be designed with high process reliability in that before the forming of an at least in part U-shaped board into an at least in part closed hollow profile using a core pulling device, a support core is positioned in the respective at least in part U-shaped board in the second tool half. Following the O-forming, the support core is removed from the completely formed at least in part closed hollow profile.

Finally, in accordance with a further embodiment, if the at least in part U-shaped die cavities have laterally displaceable partial areas of the side walls with inflow curves and when the tool is shut the side walls of the upper cavity of the first tool half displace the displaceable partial areas of the side walls of the at least in part U-shaped cavity of the second tool half in an outwards direction, then the threading process of the U-arm of the at least in part U-shaped board to an at least in part closed hollow profile is made easier.

Finally, further processing steps may also preferably be carried out in the device according to the invention in order to produce the at least in part closed hollow profile. Here, the advantage of a very precise positioning of the board before or after the forming steps can be used.

BRIEF DESCRIPTION OF THE DRAWINGS

The invention should further be described on the basis of embodiments in connection with the figures. In the figures.

DETAILED DESCRIPTION OF THE INVENTION

Figure 1:
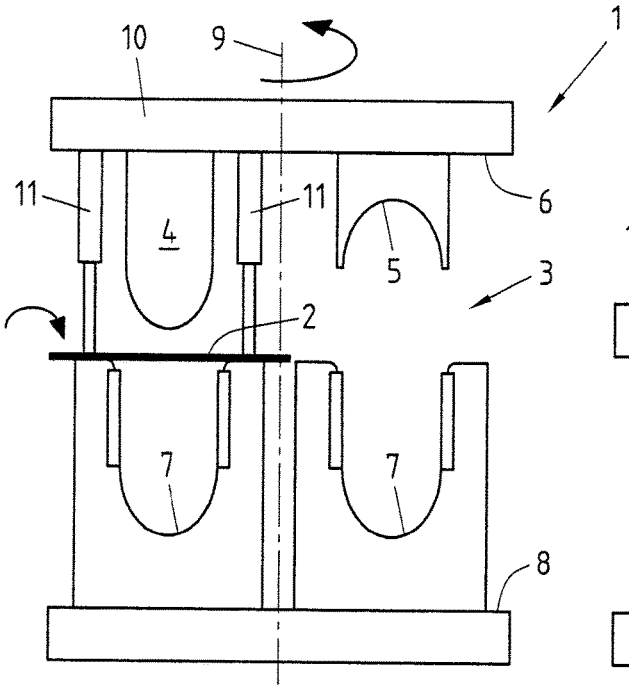
FIGS. 1 to 9 show a schematic side view of a device according to the various processing steps in the production of an at least in part closed hollow profile.

FIGS. 1 to 9 show a schematic side view of a device 1 according to the invention for the production of at least in part closed hollow profiles from a board 2 with a tool 3. The tool 3 has two tool halves 6, 8, a U-stamp 4 and an upper cavity 5 being provided in the first tool. The second tool half 8 has two identical at least in part U-shaped die cavities 7 which are arranged in a rotationally symmetrical manner to the rotational axis 9 together with the U-stamp 4 and the upper cavity 5.

When a movement is made to close the tool 3, the U-stamp 4 and the upper cavity 5 are simultaneously meshed with the two at least in part U-shaped die cavities 7 of the second tool half 8. As FIG. 1 shows, guides 11 are also provided, by means of which the material flow of the board can be controlled during the U-forming and which fix the board 2 during the forming. The mounting plate 10 on which both the U-stamp 4 and the upper cavity 5 and the guides 11 of the first tool half 6 are arranged is housed such that it can rotate about the rotational axis 9.

Figure 2:
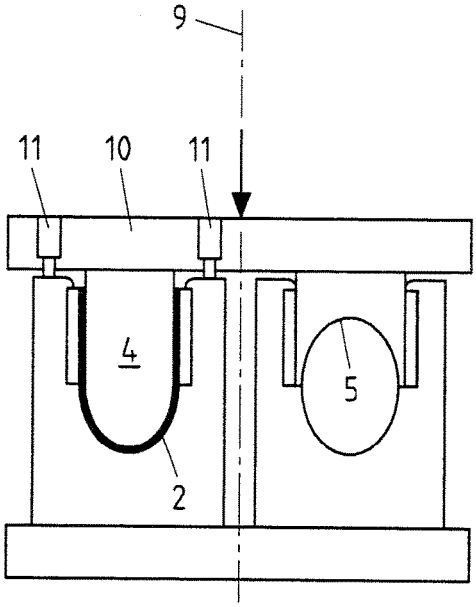
Figure 3:
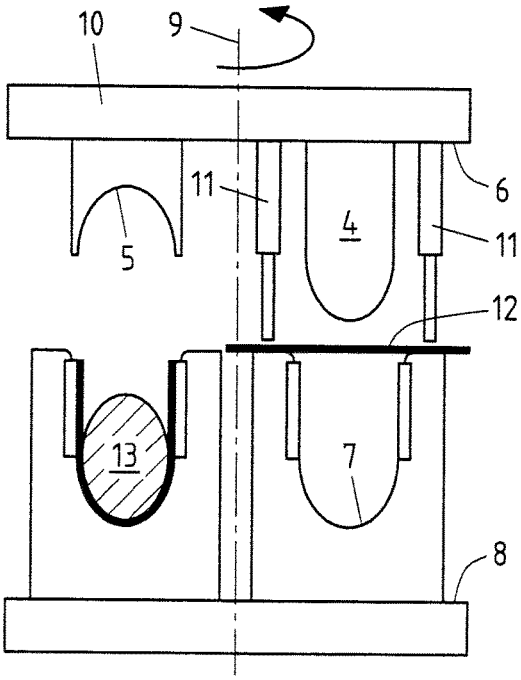
Figure 4:
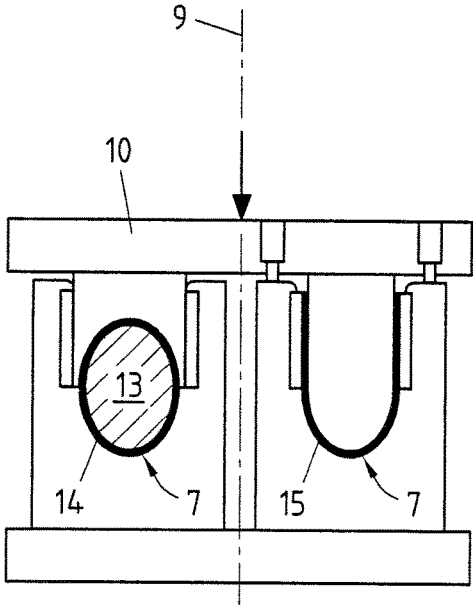

In FIG. 2, the device according to the invention is shown in a closed state. The U-stamp 4 forms the first board 2 inserted into an at least in part U-shaped board, the guides 11 controlling the material flow during the forming by setting an appropriate contact pressing force. After the end position has been reached, the tool opens again until the tool halves 6, 8 can be rotated towards one another. A rotation of the first tool half 6, as shown in the present embodiment, about the rotational axis 9 enables the positioning of the U-stamp 4 above a board 12 which is inserted in the second at least in part U-shaped cavity 7 of the tool half 8. Furthermore, as shown in FIG. 3, a support core 13 is introduced via a core pulling device (not shown) into the now at least in part U-shaped formed board 2 in the at least in part U-shaped cavity of the second tool half 8. Finally, there is a further closing movement of the tool, as shown in FIG. 4.

This closing movement generates both an at least in part closed hollow profile 2 and an at least in part U-shaped board 14. This is the first closing stroke of the tool, in which a complete, in part closed hollow profile 2 is produced.

Figure 5:
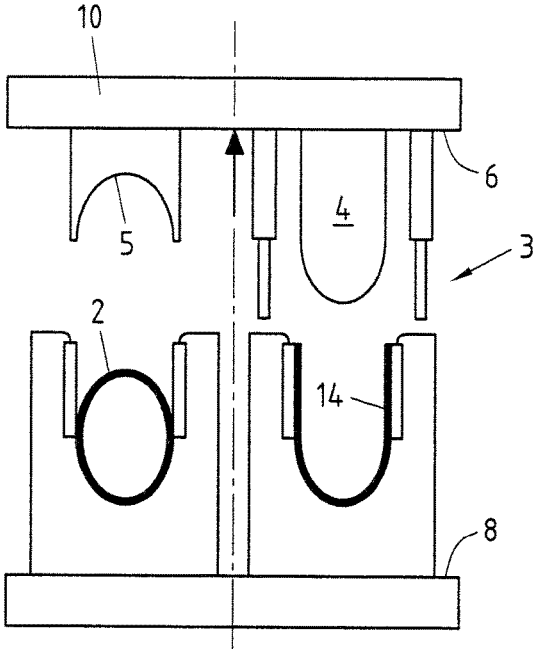
Figure 6:
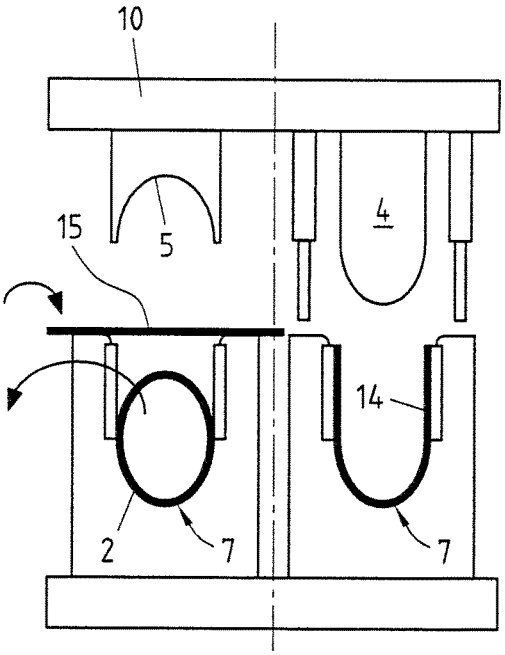
Figure 7:
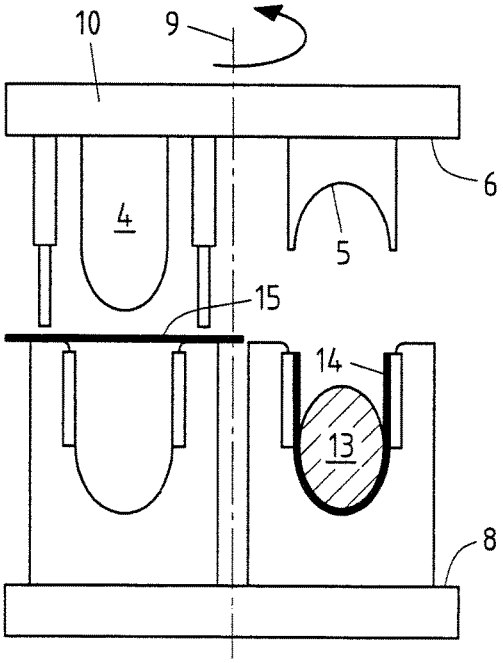

FIG. 5 shows an embodiment of the device in an open state. The in part closed hollow profile 2 can be removed from the opened tool 3, as shown in FIG. 6, and a new board 15 can be inserted into the at least in part U-shaped cavity of the second tool half 8 which becomes free as a result. Finally or before this, there is a further rotation of the first tool half 6 about the rotational axis 9 so that the stamp 4 meshes with the board 15 and the upper cavity 5 of the first tool half 6 meshes with the at least in part U-shaped board 14. Before this, a support core 13 is inserted in the at least in part U-shaped cavity 7 of the second tool half as well.

Figure 8:
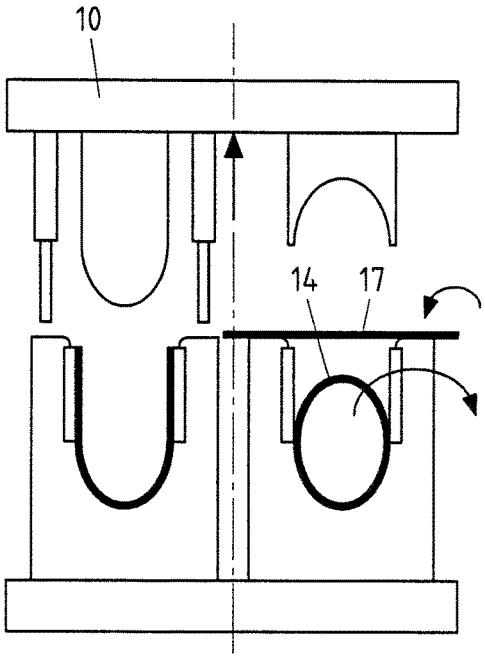
Figure 9:
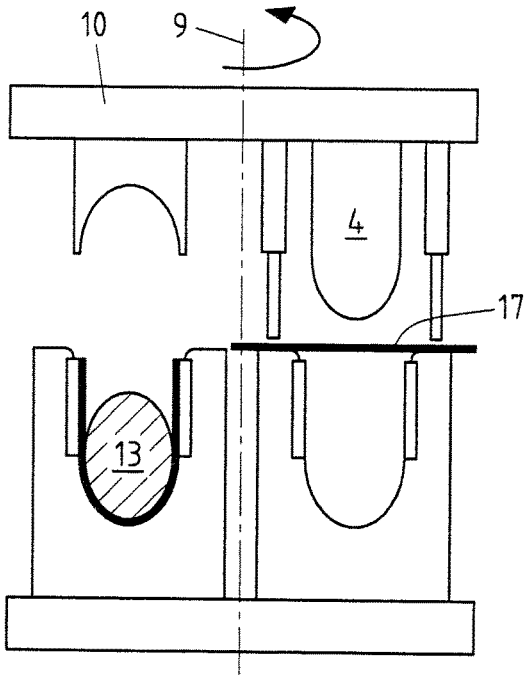

An embodiment of the device according to the invention following the next closing process in an open state is shown in FIG. 8. It is possible to identify that the U-shaped board 14 in the other, identical U-shaped cavity 7 has been formed into a complete at least in part closed hollow profile 14 and can be removed. Finally, the cavity 7 is loaded with the next board 17. In order to continue the production process, the first tool half 6 is in turn rotated towards the second tool half 8 so that the U-stamp 4 forms the newly inserted board 17 into an at least in part U-shape board when the tool is next closed, FIG. 9.

From the description of the embodiment shown it becomes clear that with the embodiment of the device according to the invention each working stroke can produce a complete, at least in part closed hollow profile and therefore the cycle times for the production can be reduced considerably.

Figure 10:
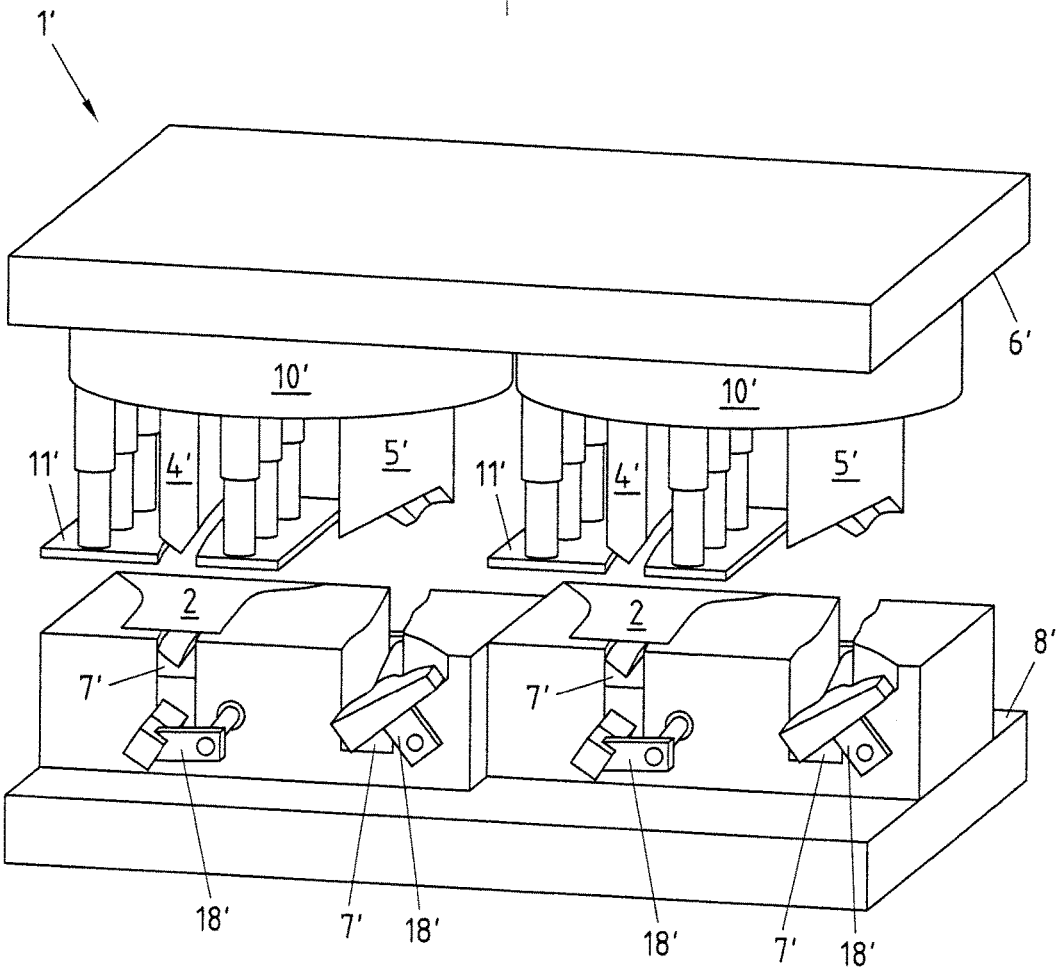
FIG. 10 shows a schematic three dimensional drawing of the device according to the invention with a plurality of U-stamps and upper die cavities arranged in pairs in a first tool half.

In order to increase the number of items further but also in order to integrate further processing steps, the embodiment shown as an example in FIG. 10 can be used. In a device, two rotatably mounted mounting plates 10' are provided for this purpose which each have a U-stamp 4', an upper cavity 5' and guides 11' in the first tool half 6'. The second tool half 8' comprises a total of four identical at least in part U-shaped die cavities 7', which are used for the U-O-forming. In addition, core pulling devices 18' are provided for each at least in part U-shaped cavity 7' of the second tool half 8' in the device 1' in FIG. 10. The device 1' shown in FIG. 10, therefore, shows a capacity which is twice that of the device shown in FIGS. 1 to 9.

Figure 11:
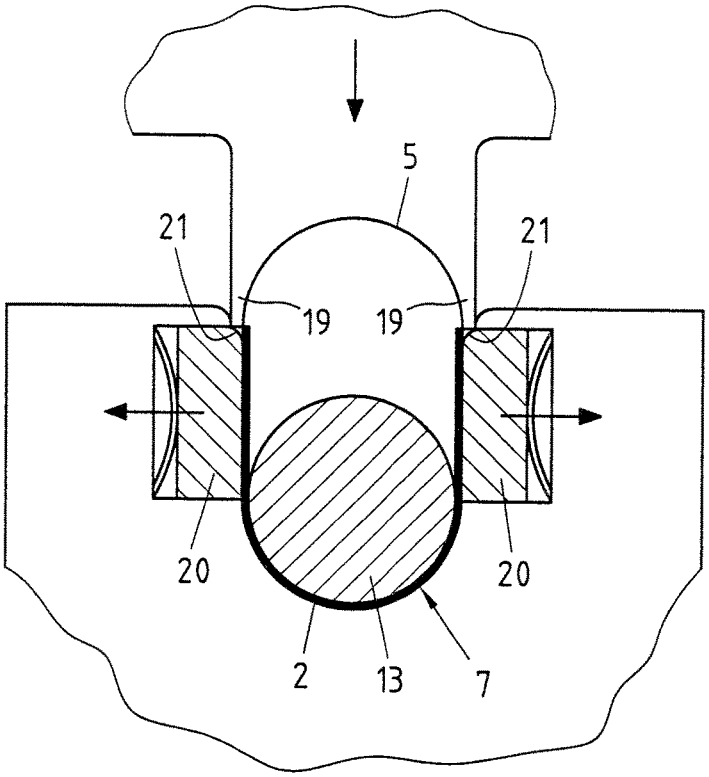
FIGS. 11 and 12 show a schematic plan view of the upper cavity of the first tool half during the threading of the arm of the at least in part U-shaped board.
Figure 12:
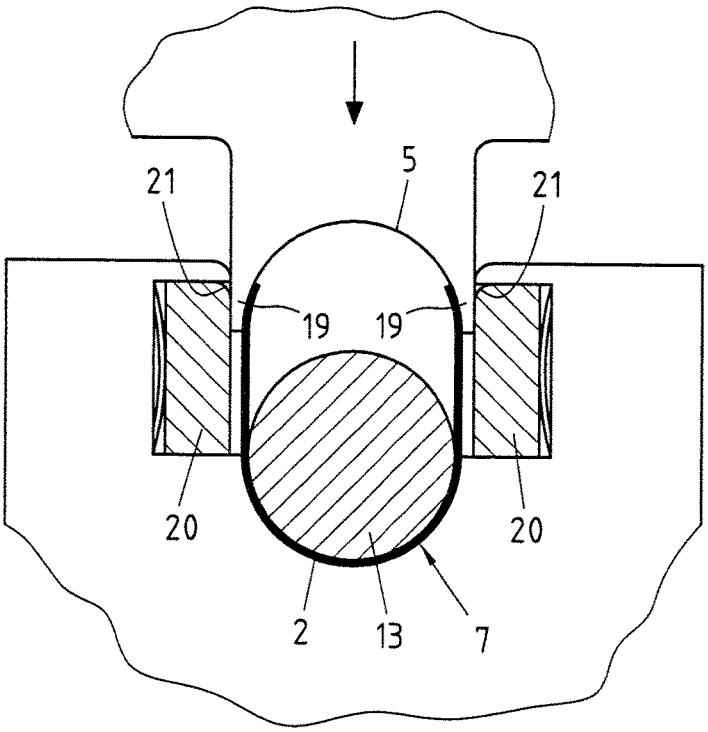

In FIGS. 11 and 12, the threading process using the laterally displaceable partial areas 20 of the side walls of the at least in part U-shaped die cavities 7 in the O-forming is shown. The upper cavity 5 has side walls 19 which displace the displaceable partial areas 20 of the side walls of the at least in part U-shaped cavity 7 of the second tool half in an outwards direction with the help of the inflow curves 21 such that the at least in part U-shaped board 2 is threaded into the upper cavity 5 in a particularly secure manner. The inflow curves 21 and the height of the side walls of the at least in part U-shaped die cavities 7 ensure that a particularly reliable threading process is achieved since the spring-back action of the U-shaped board formed in the cavity 7 is low. However, it is also conceivable for the displacement in an outwards direction of the partial areas 20 of the side walls 19 to be actively supported in order to minimise wear on the inflow curves. To this end, the side walls of the at least in part U-shaped cavity 7 have a height of at least half of the maximum, rolled out side wall length of the hollow profile to be produced, so an arm of the at least in part U-profile. Overall, in this way a reliable method of producing at least in part closed hollow profiles with a low cycle time and low investment costs can be provided.

The invention claimed is:

1. Device for producing at least in part closed hollow profiles from a board by means of a U-O-forming with a tool, comprising at least a U-stamp and at least an upper cavity in a first tool half, characterised in that at least two identical at least in part U-shaped cavities are provided in a second tool half, the U-stamp and the upper cavity of the first tool half each mesh with an at least in part U-shaped cavity, the at least one U-stamp and the at least one upper cavity of the first tool half and the at least two at least in part U-shaped cavities of the second tool half are arranged along a rotational axis running in a closing direction of the tool and the first and the second tool halves are rotatable relative to one another about said rotational axis such that rotating the first and/or the second tool half positions the U-stamp and the upper cavity to mesh with the first or the second at least in part U-shaped cavity, respectively.

2. Device according to claim 1, wherein the first or the second tool half is formed in a fixed manner, wherein the first or the second tool half are arranged on a mounting plate which is rotatable about the rotational axis.

3. Device according to claim 1, wherein a core pulling device is provided for each cavity of the second tool half.

4. Device according to claim 1, wherein guides are assigned to the U-stamp in the first tool half.

5. Device according to claim 1, wherein the at least in part U-shaped die cavities of the second tool half include side walls, the height of which is at least half of a maximum rolled out side wall length of a hollow profile to be produced.

6. Device according to claim 1, wherein the side walls of the at least in part U-shaped die cavities are displaceable at least in partial areas in an outwards direction and these partial areas have inflow curves.

7. Device according to claim 1, wherein the first tool half has a plurality of U-stamps and upper die cavities arranged in pairs and in a rotationally symmetrical manner and the second tool half has an identical number of at least in part U-shaped die cavities which are arranged in a rotationally symmetrical manner to the respective rotation axis.

8. Method for the production of an at least in part closed hollow profile using a device according to claim 1, with the following steps:

Insertion of a first level board into a first at least in part U-shaped cavity of the second tool half, Forming of the first board into an at least in part U-shaped board by closing the tool halves using the U-stamp of the first tool half, Opening of the tool and rotation of the first and second tool halves against one another along a rotational axis in the closing direction of the tool such that the U-stamp of the first tool half is positioned above the second at least in part U-shaped cavity of the second tool half and the upper cavity of the first tool half is positioned above the first at least in part U-shaped cavity of the second tool half, Insertion of a second level board into a second at least in part U-shaped cavity of the second tool half, Closing of the tool halves and simultaneous forming of the in part U-shaped first board into an at least in part closed hollow profile using the upper cavity of the first tool half and simultaneously forming the second board into an at least in part U-shaped board using the U-stamp of the first tool half.

9. Method according to claim 8, wherein the first and/or the second tool half is rotated about the rotational axis following the opening of the tool.

10. Method according to claim 8, wherein before the forming of an at least in part U-shaped board into an at least in part closed profile using a core pulling device, a support core is positioned in the respective at least in part U-shaped board in the second tool half.

11. Method according to claim 8, wherein the at least in part U-shaped die cavities have laterally displaceable partial areas of the side walls and when the tool halves are closed the side walls of the upper cavity of the first tool half displace the displaceable partial areas of the side walls of the at least in part U-shaped die cavities of the second tool half in an outwards direction.

12. Method according to claim 8, wherein further processing steps are carried out in the device.

* * * * *